United States Patent [19]

Maston et al.

[11] Patent Number: 4,695,112

[45] Date of Patent: Sep. 22, 1987

[54] PRINTED CIRCUIT BOARD, EDGEBOARD CONNECTOR THEREFOR

[75] Inventors: Donald M. Maston, Livonia; Kenneth H. Mertz, Mount Clemens, both of Mich.

[73] Assignee: Chrysler Motors Corporation, Highland Park, Mich.

[21] Appl. No.: 947,303

[22] Filed: Dec. 29, 1986

[51] Int. Cl.[4] ..... H01R 13/639

[52] U.S. Cl. ..... 439/350; 439/629; 439/680

[58] Field of Search ..... 339/91 R, 176 MF, 176 MP, 339/186 R, 186 M

[56] References Cited

U.S. PATENT DOCUMENTS 2,858,515 10/1958 Thunander et al. ..... 339/176 MP
2,935,725 5/1960 Fox ..... 339/176 MP
3,555,494 1/1971 Baumanis ..... 339/176 MP
3,920,303 11/1975 Pittman et al. ..... 339/176 MP

*Primary Examiner*—Joseph H. McGlynn
*Attorney, Agent, or Firm*—Wendell K. Fredericks

[57] ABSTRACT

Retention of terminals in an edgeboard connector for connecting wires to a printed circuit board is affected using a variety of structural elements. Lances depending from the front end of each terminal are inserted in slots in the bottom wall of the connector; stop-blocks on the interior of the connector are used to orient and retain the terminals in position within the connector housing and a lock bar is fixedly attached to a rear portion of the connector so as to abut against ears disposed on a sidewall of the terminal so as to simultaneously hold in place the entire array of terminals in the connector.

4 Claims, 6 Drawing Figures

PRINTED CIRCUIT BOARD, EDGEBOARD CONNECTOR THEREFOR

BACKGROUND OF THE INVENTION

1. Field of the Invention

This invention relates to edgeboard connectors for printed circuit boards and more particularly in a preferred embodiment to edgeboard connectors for circuit boards with edge-card type plugs which include novel wire connecting terminals which are locked in the connector's housing to prevent the wire and terminals from being undesirably removed from the connectors.

2. Description of the Prior Art

Prior art connectors include means for locking terminals in connector housings. Structures such as lances which snap into slots in the connector housing have been used for holding the terminal in place within the connector.

Also, various means have been provided for locking connectors to circuit boards to prevent removal of connectors. Lock-bolts, snaps and many other similar forms of devices have been used to hold together the connector and circuit board. However, very little attention, if any, has been given to preventing forceful removal of terminals from connector housings. With lances in slots providing the primary means for retaining the terminals in the connectors, such an arrangement could not be expected to prevent forceful removal of terminals from a connector.

BRIEF DESCRIPTION OF THE INVENTION

The present invention is concerning an edgeboard connector for connecting a plurality of wires to an edge card plug of a printed circuit board. In addition to having terminals with a lance for retention purposes and oval-shaped front ends for imposing spring-like pressure against conductor runs on the printed circuit board, the terminals of this invention are provided with right and left sidewalls. The right sidewall is used for keying the terminal to a channel in the connector housing, the left sidewall is used to provide an ear which abuts a lock bar which is used to retain all the terminals in the housing notwithstanding force being used to remove the terminal from the connector housing.

DESCRIPTION OF A PREFERRED EMBODIMENT

Figure 1:
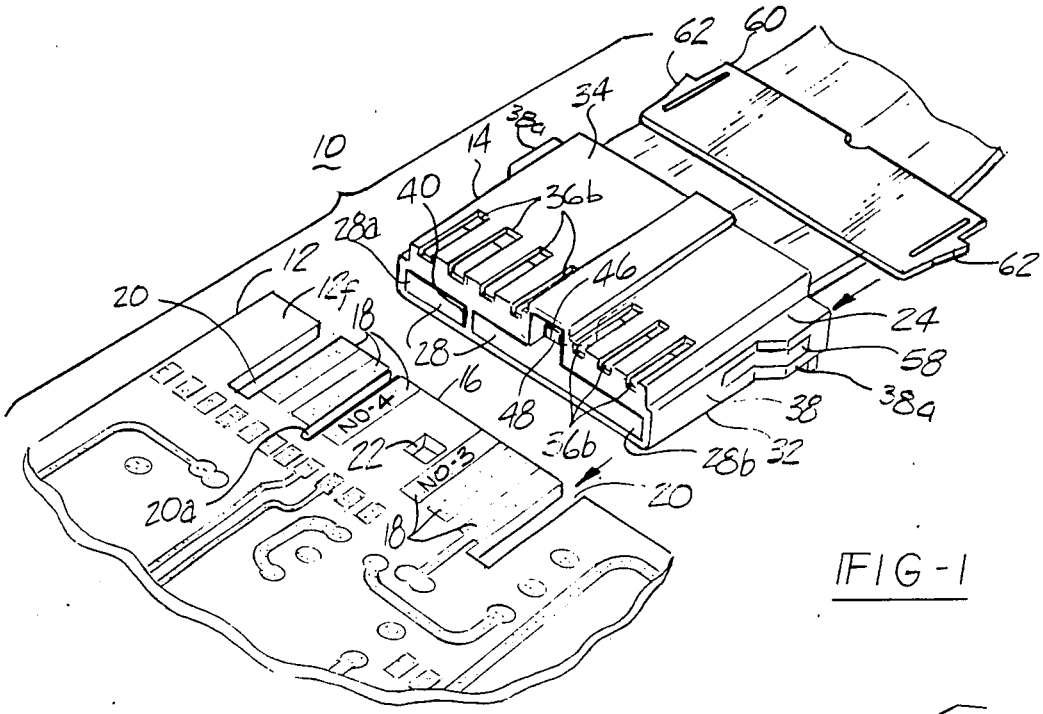
FIG. 1 is a perspective view of a printed circuit board and a connector assembly constructed in accordance with the present invention.

Referring to FIGS. 1 through 6, there is shown in FIG. 1 a printed circuit board and edge connector arrangement 10. Arrangement 10 consists of an edge-card, plug-in type printed circuit board 12 and a molded dielectric material electrical edgeboard connector 14.

Circuit board 12 has an edge card-type plug 16 consisting of a plurality of printed conductor runs 18 terminating in a parallel set pattern of conductor runs at an output end of plug 16. The conductor runs, illustratively, may be seven conventional etched copper conductor runs laminated on a front surface 12*f* of board 12. Plug 16 also includes three alignment slots 20 used for mating circuit board 12 in proper mechanical alignment and electrical polarity with edgeboard connector 14. Also in arrangement 10, in order to provide positive mechanical locking of the connector 14 to the edge card plug 16, a lock-hole 22 disposed, illustratively between conductor runs No. 3 and No. 4 of plug 16, is provided for receiving a resilient latch molded integrally in the electrical edgeboard connector 14.

Edgeboard connector 14 includes a molded housing 24 and a plurality of electrical terminals 26 that are inserted into housing 24.

Figure 2:
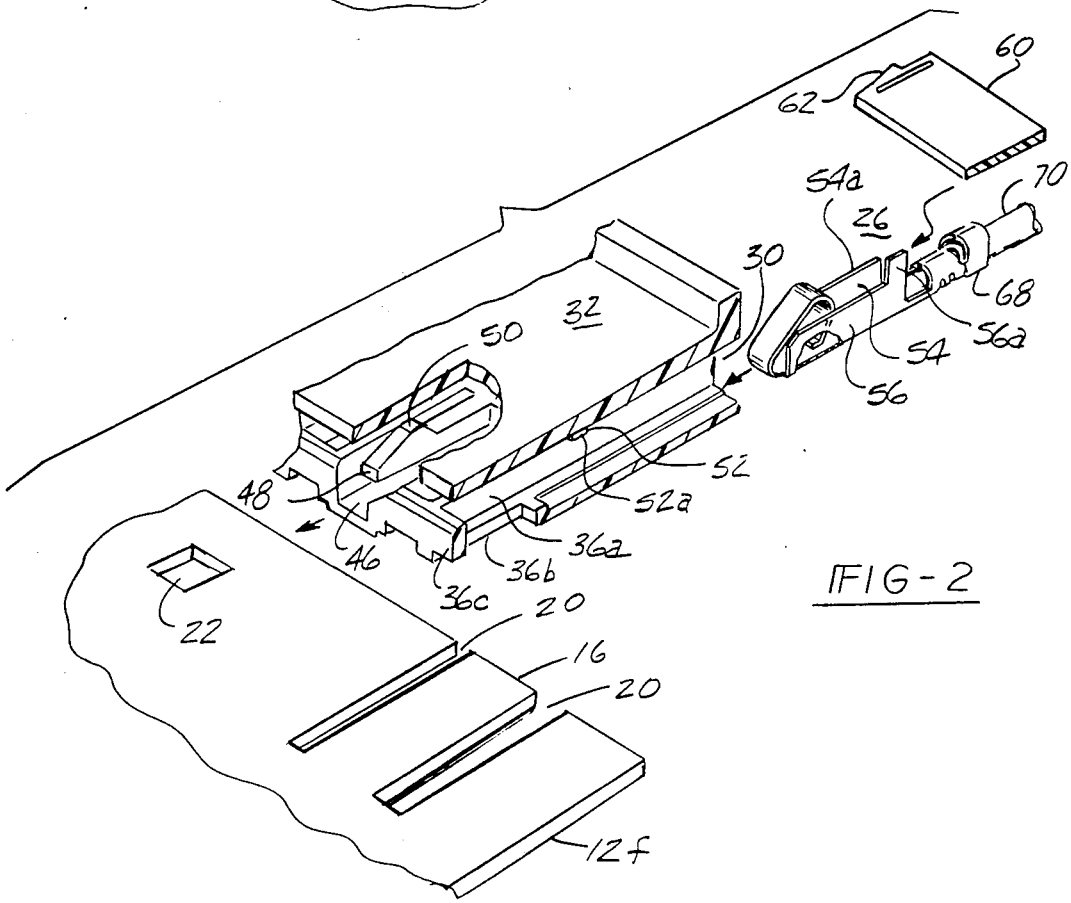
FIG. 2 is a fragmentary perspective view, partially in section depicting interfacing surfaces of structural elements of the printed circuit board and the connector.
Figure 3:
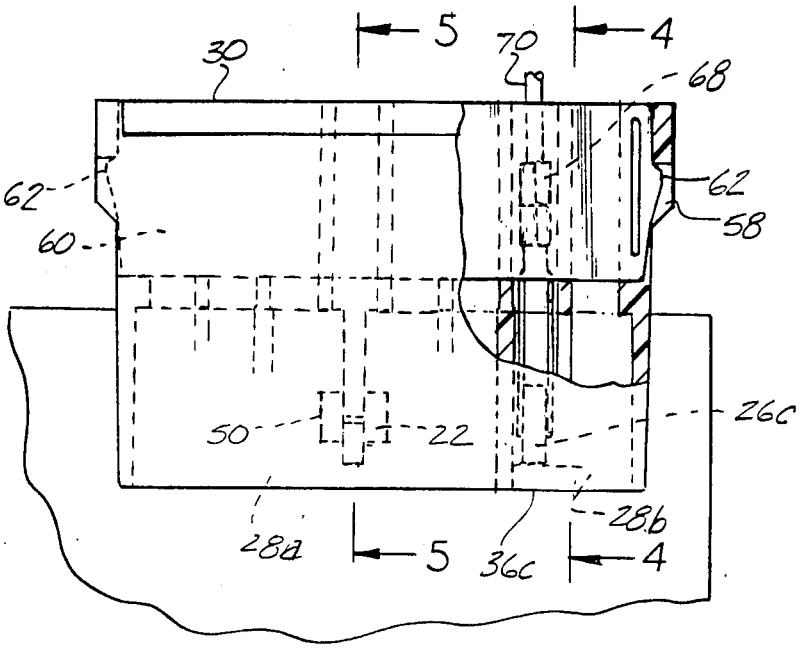
FIG. 3 is a sectional view of a printed circuit board edge card plug contacting a terminal mounted and locked in a connector.

The housing 24 comprises a front divided cavity 28 for receiving the plug 16 of circuit board 12 and a rear undivided cavity 30 (see FIG. 6) for receiving the plurality of terminals 26 (see FIGS. 1, 2 and 3). The front divided cavity 28 is formed between a smooth top surface 32; a pair of smooth front side walls 38 just forwardly tapered toward the front end of front cavity 28; and a bottom surface 34 that has a plurality of equally spaced apart channels 36 each of which being formed from a pair of parallel equally spaced channel sidewalls 36*a* of a chosen height projecting up from the bottom surface 34 and spanning the length of both the front and rear cavities. The sidewalls 36*a* terminate in the front cavity against a perpendicular front lower wall 36*c*. Within the bottom surface 34 of the front cavity between the sidewalls 36*a* of each channel 36 is a narrow slot 36*b* for receiving a lance portion 66 of a front end 26*a* of the terminal 26. (Best seen in FIG. 4).

A vertical partition 40 extends the length of the front cavity between the top and bottom surfaces 32 and 34 respectively between, illustratively channel No. 6 and channel No. 5. The partition 40 acts as an off-centered key that is inserted in a special alignment slot 20*a* of the printed circuit board 12 to ensure correct mechanical and electrical alignment of connector 14 with circuit board 12.

A first cavity 28*a* of front cavity 28 provides space near the top surface 32 for receiving that portion of the edge card plug 16 that contains illustratively, conductor runs No. 6 and No. 7 and for receiving within the channels 36 in the bottom surface 34 the forward ends 26*a* of terminals 26 which contact conductor runs No. 6 and No. 7.

Figure 6:
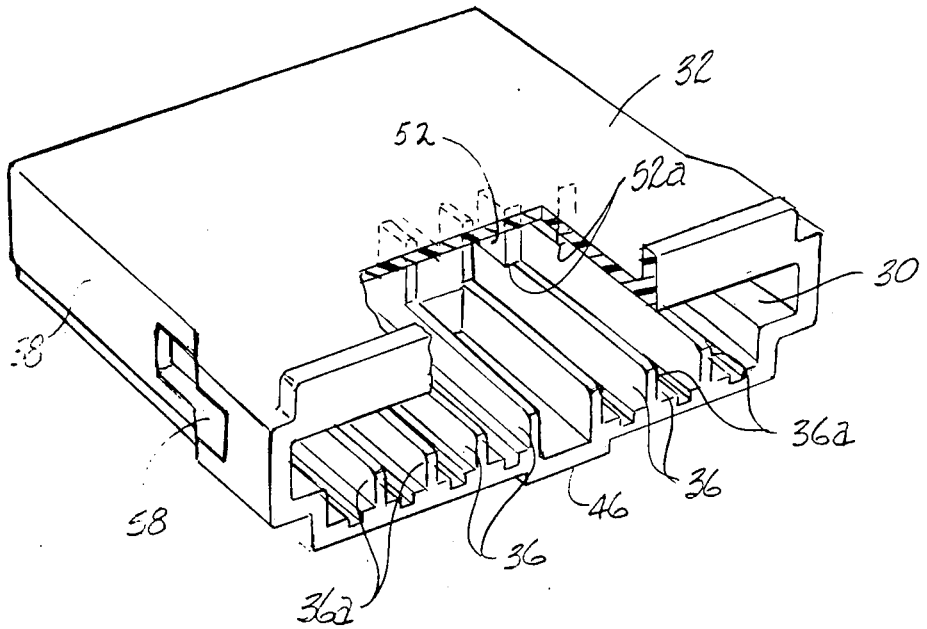
FIG. 6 is a perspective view of the connector when viewed from a rear end.

A second cavity 28*b* (as shown in FIG. 6) provides space near the top surface 32 for receiving illustratively the conductor runs Nos. 1 through 5 of the edge card plug 16 and for receiving within the channels 36 in the bottom surface 34 the forward ends 26*a* of terminals 26 which contact conductor runs Nos. 1 through 5. Within the bottom surface between, e.g., channels No. 3 and No. 4 is an expanded channel 46 that has a resilient locking arm 48 (best seen in FIG. 2) connected near the rear end of the front cavity 28 and at the bottom of channel 46 that rises towards the top surface 32. Arm 48 flexes towards the bottom of the channel when plug 16 is inserted into connector 14 and then flexes towards the top surface 32 permitting a lobe 50 on the end of arm 48 to enter and seat in the lock hole 22 in plug 16 of printed circuit board 12 locking board 12 to connector 14.

Near the rear of front cavity 28 and top surface 32, there are a plurality of molded stop blocks 52 that project a chosen distance from the top surface and are equally spaced apart but offset a chosen distance above each channel so that only one block 52 is associated with each channel 36 as shown in FIG. 6. Each stop block 52 in each channel allows, as a terminal is inserted into the housing via rear cavity 32, a top surface **54*a* of a right guide plate 54 of each terminal 26 to slide against and in alignment with a bottom surface 52*a* of stop block 52. This action assures that each terminal is oriented and inserted correctly within channel 36. Surface 52*a* also acts against top surface 54*a* of right guide plate 54 to retain the terminal 26 in proper alignment within channel 36 for accepting and making electrical contact with the conductor runs on plug 16. This action prevents terminal 26 from rising up within channel 36 and obstructing the mating of plug 16 with the front cavity 28 of the molded connector 14**.

Figure 4:
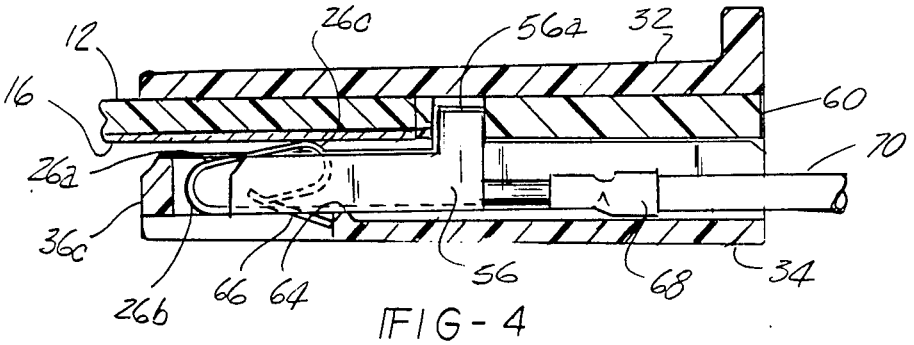
FIG. 4 is a partial section of a side view of a connector of FIG. 3 depicting the location of the stop bars relative to the side walls of the channels in the bottom face of the connector.
Figure 5:
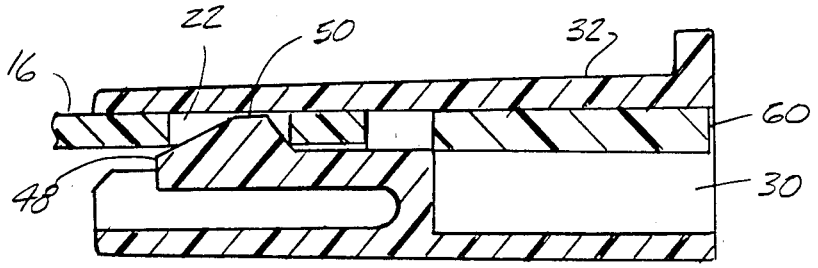
FIG. 5 is side view of the connector of FIG. 3 illustrative of the lock hole in the printed circuit board receiving the lobe of the lock arm.

A left guide plate 56 has a rear locking ear **56*a* which, when each terminal 26 is inserted into one of the channels 36 via rear cavity 30, is used for contacting a front edge of a secondary lock bar 60 as shown in FIGS. 2 and 4**.

As shown in FIG. 1, the rear undivided cavity 30 includes a pair of sidewall extensions **38*a* of the front sidewalls 38. Within each sidewall extension in a region above the height of the channel sidewalls 36*a* is an aperture 58 for receiving one of a pair of collapsible nibs 62 of a secondary lock bar 60. Secondary lock bar 60 includes the pair of collapsible nibs 62, the nibs being disposed at opposite ends of lock bar 60. Lock bar 60 is used to provide an additional lock for keeping the terminals 26** in place during handling and use.

Each terminal 26, fabricated from a single piece of spring tempered sheet brass, is formed to the shape shown in FIGS. 2 and 4 to provide a resilient body. In addition to the sidewalls 54 and 56 terminal 26 has a base 64, a lance 66 depending outwardly from base 64. The base 64 also includes a pair of crimping arms 68 spaced from right and left guide plates 54 and 56 respectively at a rear end of terminal 26, for crimping a wire 70 to terminal 26.

The front end **26*a* of each terminal 26 includes a first arcuate surface 26*b* which curves upwardly and rearwardly from the base 64. Surface 26*b* merges with a second arcuate surface 26*c* which reversely curves between right and left guide plates 54 and 56 and above the top surface of base 64 forming a resilient front end 26*a*. The height of the front end 26*a* of each terminal 26 is such that the second arcuate surface 26*c* intercepts a conductor run on printed circuit board 12 producing electrical contact between the terminals in connector 14 and the conductor runs of plug 16 when the edge card plug 16 of board 12 is inserted into the front cavity 28 of connector 14. As plug 16 is inserted, the resilient front end 26*a* flexes about the first arcuate surface 26*b* exerting contact pressure against the conductor runs at the plug 16**.

The lance 66 depending outwardly from base 64 of each terminal 26, snaps into slots **36*b* of each channel 36 providing the locking means which prevents accidental retraction of each terminal 28**.

While the present invention has been disclosed in connection with the preferred embodiment thereof, it should be understood that there may be other embodiments which fall within the spirit and scope of the invention and that the invention is susceptible to modification, variation and change without departing from the proper scope or fair meaning of the following claims.

We claim:

1. An edgeboard connector for connecting a plurality of wires to an edge-card plug of a printed circuit board;

wherein a plurality of terminals each of which having an oval-shaped front end which imposes spring-like pressure against conductor runs terminating within the edge-card plug are positioned in a plurality of channels disposed along a bottom surface of the connector;

wherein each of the plurality of terminals has a lance depending from a base of the terminals which snaps into a slot in each of the plurality of channels for locking each terminal in each channel to prevent accidental retraction of the terminal during use;

wherein each terminal includes a pair of crimping arms at a rear end of each terminal for crimping a wire to the terminal;

wherein the edge-card plug of the printed circuit board has at least one slot used for mating the circuit board in proper mechanical alignment and electrical polarity with the edgeboard connector; and wherein the edge-card plug also has a lock hole near one of the three alignment slots that is near the central region of the plug for receiving a lobe on the end of a locking arm formed in one of the plurality of channels along the bottom surface of the connector, the lock arm rising from the bottom of the channel towards a top surface of the connector, the lobe and the lock hole being used for locking the plug to the connector, said connector comprising:

(a) a divided front cavity for receiving the edge-card plug of the printed circuit board, said front cavity having a vertical partition extending the length of said front cavity between the top and bottom surface of the connector, said partition being in alignment with the alignment slot near the central region of the edge-card plug;

(b) a plurality of stop blocks near the rear of said front cavity that project a chosen distance from the top surface, each of said plurality of stop blocks being equally spaced apart but offset a chosen distance above each channel so that only one of said plurality of stop blocks is above each of the channels, said stop blocks being used for ensuring that the terminals of the connector are oriented and inserted correctly within the channels;

(c) an undivided rear cavity for receiving the terminals and the attached wires which are mated with the conductor runs terminating at the plug of the circuit board, said rear cavity having sidewalls which are the extensions of sidewalls of said front cavity, each of said rear sidewalls having an aperture in a region above the height of sidewalls of the plurality of channels disposed along the bottom surface of the connector;

(d) a right and a left sidewall of each of the terminals disposed between the oval-shaped front end and the crimping arms, said right sidewall having a height that permits a top surface of said right sidewall to slide against and in alignment with a bottom surface of said stop block in each of the channels for assuring that each terminal is oriented and inserted correctly within the channel, said left sidewall of each terminal having a rear locking ear which rises from a top surface of said left sidewall towards the top surface of the connector when the terminal is inserted into a channel in correct orientation;

(e) a lock bar including a pair of collapsible nibs, one of each of said pair of nibs being disposed at opposite ends of said lock bar, said lock bar having a front edge for contacting said ears of said left sidewall of each of the terminals inserted into the channels of the connector, said collapsible nibs of said lock bar being inserted into said apertures of said rear walls of said rear cavity for providing an additional lock for keeping the plurality of terminals in place when the connector is connected to the edge-card plug of the printed circuit board.

2. Connector of claim 1 wherein said connector includes a molded housing, wherein said plurality of stop blocks are molded integrally with the top surface of the housing.

3. Connector of claim 1 wherein said plurality of terminals each of which having said left and right sidewalls is formed from a single piece of sheet brass.

4. Connector of claim 1 wherein said plurality of stop blocks are used to act against a top surface of said right guide plate of each of said terminals to retain each of said terminals in proper alignment within the respective channel for accepting and making electrical contact with the conductor runs on the plug and wherein this action prevents each terminal from rising up within each channel so as to obstruct the mating of the plug to the connector.

* * * * *